US008414417B2

(12) United States Patent
Sato

(10) Patent No.: US 8,414,417 B2
(45) Date of Patent: Apr. 9, 2013

(54) GOLF CLUB SHAFT AND GOLF CLUB THEREWITH

(75) Inventor: Fumiaki Sato, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 253 days.

(21) Appl. No.: 12/427,379

(22) Filed: Apr. 21, 2009

(65) Prior Publication Data

US 2009/0305809 A1 Dec. 10, 2009

(30) Foreign Application Priority Data

Jun. 5, 2008 (JP) ..... 2008-147893

(51) Int. Cl.
*A63B 53/10* (2006.01)

(52) U.S. Cl.
USPC ..... 473/316

(58) Field of Classification Search ..... 473/316–323
See application file for complete search history.

(56) References Cited

U.S. PATENT DOCUMENTS

| | | | | |
|---|---|---|---|---|
| 5,551,691 | A * | 9/1996 | Harada et al. | 473/323 |
| 6,322,458 | B1 | 11/2001 | Kusumoto et al. | |
| 7,070,512 | B2 * | 7/2006 | Nishio | 473/319 |
| 7,318,780 | B2 * | 1/2008 | Oyama | 473/319 |
| 7,361,098 | B2 | 4/2008 | Oyama | |
| 7,427,240 | B2 * | 9/2008 | Takeuchi | 473/319 |
| 7,524,248 | B2 * | 4/2009 | Kumamoto | 473/319 |
| 8,021,244 | B2 * | 9/2011 | Kato | 473/319 |
| 2001/0014626 | A1 * | 8/2001 | Takiguchi et al. | 473/316 |
| 2004/0142760 | A1 * | 7/2004 | Haas et al. | 473/319 |
| 2006/0116217 | A1 * | 6/2006 | Oyama | 473/316 |
| 2008/0004127 | A1 * | 1/2008 | Takeuchi | 473/292 |
| 2008/0070716 | A1 * | 3/2008 | Kumamoto | 473/289 |

FOREIGN PATENT DOCUMENTS

| | | | |
|---|---|---|---|
| JP | 08089605 | A * | 4/1996 |
| JP | 09-234256 | A | 9/1997 |
| JP | 11033152 | A * | 2/1999 |
| JP | 11-206932 | A | 8/1999 |
| JP | 11206932 | A * | 8/1999 |
| JP | 2000126338 | A * | 5/2000 |
| JP | 2002-177423 | A | 6/2002 |

(Continued)

OTHER PUBLICATIONS

Takeuchi, USPTO Human English Translation of JP 2007-117109, Dec. 2010, pp. 1-40.*

(Continued)

*Primary Examiner* — Gene Kim
*Assistant Examiner* — Matthew B Stanczak
(74) *Attorney, Agent, or Firm* — Sughrue Mion, PLLC

(57) ABSTRACT

A golf club shaft that has a flexural rigidity distribution allows a user to easily adjust swing timing even when a golf club using the golf club shaft is long. The golf club shaft comprises a section, wherein the flexural rigidity EI of the shaft monotonically increases in the section from the point 500 mm to the point 800 mm, wherein $\Delta 1/\Delta 2$ is at least about 1.5 where $\Delta 1$ is the rate of change of the flexural rigidity EI of the shaft between points 500 mm and 600 mm from the tip end, and $\Delta 2$ is the rate of change of the flexural rigidity EI between points 700 mm and 800 mm from the tip end, and wherein the flexural rigidity EI at a point 750 mm from the tip end is at least about $4.1\times10^6$ kgf*mm$^2$.

9 Claims, 3 Drawing Sheets

FOREIGN PATENT DOCUMENTS

| | | | | |
|---|---|---|---|---|
| JP | 2002-233597 | A | | 8/2002 |
| JP | 2003-093562 | A | | 4/2003 |
| JP | 2003102883 | A | * | 4/2003 |
| JP | 2003135635 | A | * | 5/2003 |
| JP | 2004129687 | A | * | 4/2004 |
| JP | 2005034550 | A | * | 2/2005 |
| JP | 2005176960 | A | * | 7/2005 |
| JP | 2006-102038 | A | | 4/2006 |
| JP | 2007117109 | A | * | 5/2007 |
| JP | 2007-135811 | A | | 6/2007 |
| JP | 2008212340 | A | * | 9/2008 |

OTHER PUBLICATIONS

Japanese Office Action issued in Japanese Application No. 2008-147893 dated Jul. 31, 2012.

* cited by examiner

GOLF CLUB SHAFT AND GOLF CLUB THEREWITH

BACKGROUND OF THE INVENTION

The present invention relates to a golf club shaft and to a golf club having the same.

Golf club shafts have a flexural rigidity distribution over the entire length from the tip end to the butt end that is designed to hit a longer ball. For example, according to Japanese Patent Application Publication No. 9-234256, a flexural rigidity distribution is designed so that the flexural rigidity is higher in a middle part between a point 300 mm from the tip end and a point 300 mm from the butt end. Such a flexural rigidity distribution helps to keep the axis of the shaft substantially straight during a swing, thus facilitating accurately recovering of the position of the club face at the time of addressing, so that the flying distance increases, and the directional accuracy improves.

In addition, according to Japanese Patent Application Publication No. 2002-177423, the rate of change of the flexural rigidity in a section H having a length of 100 to 450 mm within a range from a point 0 mm to a point 450 mm from the butt end of the shaft is one to five times as high as the rate of change of the flexural rigidity in a section M having a length of 200 to 500 mm within a range from a point 400 mm to a point 900 mm from the butt end of the shaft. In the section M, the flexural rigidity slowly increases from the tip end toward the butt end. Thus, the section M provides sufficient flexure and restoring force and thus contributes to increasing the flying distance. In the section H, the rate of change of the flexural rigidity is higher than in the section M to provide higher flexural rigidity. Thus, the section H contributes to providing firm grip feeling and high directional stability.

SUMMARY OF THE INVENTION

Among other golf clubs, many recent drivers are longer than 46 inches. In general, the longer the club, the flexure of the shaft increases, and the time to recover the flexure increases. Therefore, golfers feel that long clubs are difficult to adjust swing timing. Thus, there is a problem that golfers cannot adequately take advantage of the length of the club because of the swing difficulty and the feeling of anxiety.

In view of the problem described above, an object of the present invention is to provide a golf club shaft that has a flexural rigidity distribution that allows a user to easily adjust swing timing even when a golf club using the golf club shaft is long and a golf club having the same.

In order to attain the object described above, a golf club shaft according to the present invention comprises a section between a point 500 mm and a point 800 mm from a tip end of the shaft, wherein the flexural rigidity EI of the shaft monotonically increases in the section from the point 500 mm to the point 800 mm, wherein $\Delta1/\Delta2$ is at least about 1.5 provided that the rate of change of the flexural rigidity EI of the shaft in a first subsection between a point 500 mm and a point 600 mm from the tip end is denoted by $\Delta1$, and the rate of change of the flexural rigidity EI of the shaft in a second subsection between a point 700 mm and a point 800 mm from the tip end is denoted by $\Delta2$, and wherein the flexural rigidity EI of the shaft at a point 750 mm from the tip end is at least about $4.1\times10^6$ kgf*mm$^2$.

The weight of the shaft can be about 35 to about 55 g. The flexural rigidity EI of the shaft at a point 155 mm from the tip end can be about $2.0\times10^6$ kgf*mm$^2$ to about $3.0\times10^6$ kgf*mm$^2$. The minimum value of the flexural rigidity EI of the shaft along the entire length of the shaft can be at least about $1.0\times10^6$ kgf*mm$^2$, and the maximum value of the flexural rigidity EI can be at most about $5.0\times10^6$ kgf*mm$^2$.

A golf club according to the present invention has a total length of about 46 to about 50 inches and comprises a golf club shaft having a flexural rigidity distribution described below. Specifically, the flexural rigidity EI of the shaft in a section between a point 500 mm and a point 800 mm from a tip end of the shaft monotonically increases from the point 500 mm to the point 800 mm. $\Delta1/\Delta2$ is at least about 1.5 provided that the rate of change of the flexural rigidity EI of the shaft in a first subsection between a point 500 mm and a point 600 mm from the tip end is denoted by $\Delta1$. The rate of change of the flexural rigidity EI of the shaft in a second subsection between a point 700 mm and a point 800 mm from the tip end is denoted by $\Delta2$, and wherein the flexural rigidity EI of the shaft at a point 750 mm from the tip end is at least about $4.1\times10^6$ kgf*mm$^2$. The golf club can comprise a golf club head having a center-of-gravity distance of about 25 to 45 mm.

In general, the part of a golf club in which golfers feel the flexure of the club is the part in which the flexibility of the shaft rapidly increases. The longer the golf club, the more the flexure of the shaft increases, so that it becomes more difficult for golfers to adjust swing timing. To deal with this problem, the rate of change $\Delta2$ of the flexural rigidity of the second subsection between a point 700 mm and a point 800 mm from the tip end is lowered to increase by design the rigidity of the part closer to the butt end of the shaft, and the rate of change $\Delta1$ of the flexural rigidity of the first subsection between a point 500 mm and a point 600 mm from the tip end is relatively raised so that the part in which golfers feel the flexure of the shaft lies within the first subsection from a point 500 mm to a point 600 mm from the tip end. As a result, even in the case of a long golf club, golfers are not conscious of the length and can adjust timing in the same way as in the case of a club with a normal length.

DETAILED DESCRIPTION OF THE PREFERRED EMBODIMENTS

Figure 1:
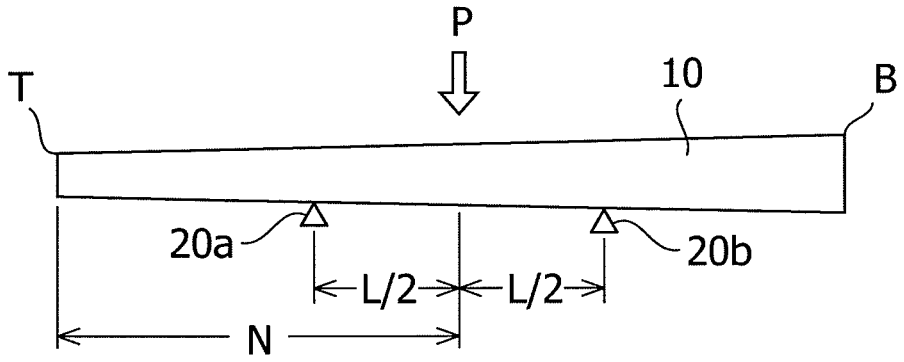
FIG. 1 is a schematic diagram for illustrating a method of measuring the flexural rigidity EI of a golf club shaft.

Hereinafter, embodiments of a golf club shaft and a golf club according to the invention will be explained with reference to the accompanying drawings. As shown in FIG. 1, a golf club shaft 10 has the shape of a cylinder tapered from the butt end B toward the tip end T. A golf club head (not shown) is attached to the tip end of the shaft 10, and a grip (not shown) is attached to the butt end. The lower limit of the length of the shaft 10 is preferably about 1050 mm and more preferably about 1100 mm. The upper limit of the length of the shaft 10 is preferably about 1170 mm and more preferably about 1150 mm.

EI means the product of the Young's modulus E and the geometrical moment of inertia I and indicates the flexural rigidity of each part of the shaft 10. The value of EI can be calculated by the three-point bending test according to the formula described below. In the three-point bending test, first, the shaft 10 is placed in a horizontal position on a pair of supports 20 spaced apart by a predetermined distance L. Then, a load P is vertically applied to the shaft 10 at a central point between the pair of supports 20, that is, the point of EI measurement. The amount of strain C of the shaft at the point of EI measurement is measured, and the value of EI [kgf*mm$^2$] is determined. Typically, the distance L between the supports 20 is 300 mm, and the load P is 20 kg.

$$EI=(L^3/48)*(P/\sigma)$$

L: distance between the pair of supports [mm]

P: load applied to the shaft [kg]

σ: amount of strain of the shaft under load [mm]

The point of EI measurement is indicated by the distance N from the tip end T of the shaft. The value of EI of the shaft 10 is designed to monotonically increase in a section between a point 500 mm and a point 800 mm from the tip end T. The phrase "monotonically increase" means that the EI value does not change or increase as the point of EI measurement moves from the tip end T to the butt end B of the shaft. The phrase also means that the EI value increases substantially linearly or according to a curve of a higher order, such as a curve of the second order and a curve of the third order, for example.

Supposing that the rate of change of EI in the first subsection between a point 500 mm and a point 600 mm from the tip end T is denoted by Δ1, and the rate of change of EI in the second subsection between a point 700 mm and a point 800 mm from the tip end T is denoted by Δ2, the shaft 10 is configured so that Δ1/Δ2 is equal to or higher than about 1.5, and the value of EI measured at a point 750 mm from the tip end T is equal to or higher than about 4.1×10$^6$ kgf*mm$^2$. Once a grip is fitted on the butt end part of the shaft, the tip end of the grip is positioned at a point about 800 mm from the tip end T. The first subsection between the point 500 mm and the point 600 mm from the tip end forms substantially the middle part of the shaft.

In general, the part of a golf club in which golfers feel the flexure of the club is the part in which the flexibility of the shaft rapidly increases. The longer the golf club (equal to or longer than about 46 inches for drivers, for example), the more the flexure of the shaft increases, so that it becomes more difficult for golfers to adjust swing timing. To deal with this problem, as described above, the flexural rigidity in the second subsection between the point 700 mm and the point 800 mm from the tip end T is totally raised, and the rate of change Δ2 of the flexural rigidity of the second subsection is lowered to increase by design the rigidity of the part closer to the butt end of the shaft 10, and at the same time, the flexural rigidity in the first subsection between the point 500 mm and the point 600 mm from the tip end T is relatively lowered, and the rate of change Δ1 of the flexural rigidity of the first subsection is raised, so that the middle part of the shaft feels flexible. As a result, even in the case of a long golf club, golfers can adjust timing in the same way as in the case of a club with a normal length (a driver having a length of about 45 inches, for example).

The lower limit of Δ1/Δ2 is more preferably about 1.7. The upper limit of Δ1/Δ2 is preferably about 4.0 and more preferably about 3.5. The lower limit of the EI value at the point 750 mm from the tip end T is more preferably about 4.2×10$^6$ kgf*mm$^2$. The upper limit of the EI value at the point 750 mm from the tip end T is preferably about 6.0×10$^6$ kgf*mm$^2$ and more preferably about 5.0×10$^6$ kgf*mm$^2$. The upper limit of the EI value at the point 550 mm from the tip end T is preferably about 3.5×10$^6$ kgf*mm$^2$. The lower limit of the EI value at the same point is preferably about 2.8×10$^6$ kgf*mm$^2$.

The weight of the shaft 10 is preferably equal to or less than about 55 g and more preferably equal to or less than about 50 g. By reducing the weight of the shaft in this way, a heavier club head can be used, and thus, a long club that has a swing balance that allows average golfers to swing in a stable path can be designed. The swing balance is preferably C5 to D2 and more preferably C8 to D0 in the 14-inch method. In addition, the weight of the shaft 10 is preferably equal to or more than about 35 g and is more preferably equal to or more than 40 g. When the shaft is too light, if the shaft is made of an ordinary carbon fiber reinforced resin, the torque of the shaft increases, and the impact feeling is very poor when the golfer hits a ball at an area outside the sweet area of the golf club head.

The point closest to the tip end T at which EI can be measured in the three-point bending test is about 155 mm therefrom. The EI value measured at the point 155 mm from the tip end T is preferably equal to or higher than about 1.0×10$^6$ kgf*mm$^2$ and more preferably equal to or higher than about 1.5×10$^6$ kgf*mm$^2$. This is because, if the tip end part of the shaft 10 is too flexible, the launching angle of the shot is not stable and varies significantly. In addition, the EI value measured at the point 155 mm from the tip end T is preferably equal to or lower than about 3.0×10$^6$ kgf*mm$^2$ and more preferably equal to or lower than about 2.5×10$^6$ kgf*mm$^2$. This is because, if the tip end part of the shaft 10 is too rigid, the launching angle of the shot is too low, and the ball cannot be hit high in the air.

At any point along the shaft 10, the EI value is preferably equal to or higher than about 1.0×10$^6$ kgf*mm$^2$ and more preferably equal to or higher than about 1.5×10$^6$ kgf*mm$^2$. Typically, the EI value measured in the three-point bending test described above is lowest at a point 200 mm to 250 mm from the tip end T of the shaft. Since a golf club head is to be attached to the tip end T of the shaft 10, a triangular reinforcing material is wrapped around the tip end part of the shaft to make the diameter thereof uniform. Thus, the EI value is lowest around a point where the reinforcing material ends. If the EI value at the point 200 mm to 250 mm from the tip end T is equal to or higher than the value described above, the stability of the behavior of the shaft during swing can be ensured.

A commonly used golf club head (not shown) is a hollow head made of metal or a head having at least the joint part to the shaft made of metal. The tip end part of the shaft 10 is inserted in the shaft inserting hole of the hosel of the head for about 30 mm to 40 mm and secured there by an adhesive, such as epoxy resin. In the case of an iron or the like, insertion of about 20 to 25 mm of the tip end part provides adequate adhesive strength. However, the driver, which is longer than the other golf clubs and impacts against a ball at high head speed, is subjected to higher impact when hitting a ball, and thus, the driver is preferably inserted and secured for a greater length.

At any point along the shaft 10, the EI value is preferably equal to or lower than about 5.5×10$^6$ kgf*mm$^2$ and more preferably equal to or lower than about 5.0×10$^6$ kgf*mm$^2$. Typically, the EI value is highest at a point close to the butt end B of the shaft. A rigid shaft that has an EI value higher than the value described above is difficult for average golfers to bend and thus adjust timing of starting downswing from the top position. In addition, the shaft is not adequately bent during the swing, so that the flying distance of the ball decreases.

The torque of the shaft 10 is preferably equal to or higher than 3.0 degrees. If the torque is too low, the head does not move, and the shaft feels rigid, and the impact feeling is compromised when hitting a ball. In addition, the torque is preferably equal to or lower than 6.0 degrees. If the torque is too high, recovery of the head is delayed, and the solid feeling is compromised. For example, a right-handed golfer cannot recover the right position of the golf head face at the time of impact and thus slices the ball toward the right.

Golfers who are less powerful and cannot achieve high head speed preferably use a shaft that has a high torque and a low weight. For example, it is preferred that the weight of the shaft be equal to or lower than 45 g, and the torque be 5 to 6 degrees. Alternatively, it is preferred that the weight of the shaft be 45 to 55 g, and the torque be 4 to 5 degrees. Alternatively, it is preferred that the weight of the shaft be equal to or higher than 56 g, and the torque be 3 to 4 degrees.

The torque can be measured by the method described below. First, the part of the shaft from a point 1040 mm from the tip end thereof is fixed with a fixing member, and a jig is attached to the part of the shaft between the tip end and a point 50 mm from the tip end. At a point 25 mm from the tip end, an arm with a length of 1 foot having a weight with a weight of 1 pound attached at the tip end is horizontally installed on the jig in such a manner that the arm intersects with the shaft. Thus, a force of 1 foot-pound (13.83 kg cm) is applied to the shaft, and the shaft twists. Then, at the point 50 mm from the tip end, the angle of the twist of the shaft, that is, the torque, is measured.

The shaft 10 thus configured is preferably formed by stacking a plurality of layers of fiber reinforced resin (FRP) prepregs and setting the same. As the reinforcing fiber for the fiber reinforced resin, a carbon fiber may be used alone, a bicomponent fiber composed of a carbon fiber and another fiber may be used, or a metallic fiber may be used. As the matrix resin, a thermosetting resin, such as epoxy resin, may be used. The fiber reinforced resin prepregs may be classified into the straight layer type, in which the direction of the fibers is parallel with the axis of the shaft, and the bias layer type, in which the direction of the fibers is oblique with respect to the axis of the shaft, or may be classified into a type in which the prepreg has the same length as the shaft or an auxiliary type in which the prepreg is shorter than the shaft. The golf club shaft configured as described above can be manufactured by using combinations of such various kinds of prepregs.

The golf club shaft according to the present invention is preferably combined with a golf club head described below to form a golf club. The golf club is preferably a driver.

The weight of the head is preferably equal to or more than about 180 g and more preferably equal to or more than about 185 g. If the head is too light, the momentum at the time of impact against the ball is low, and the initial velocity of the ball is also low. In particular, energy loss is high in the case of off center hitting. In addition, the weight of the head is preferably equal to or less than about 200 g and more preferably equal to or less than about 195 g. If the head is too heavy, the head speed is disadvantageously low. In addition, the head feels too effective, and the swing feeling is compromised.

The volume of the head is preferably equal to or more than about 300 cc and more preferably equal to or more than about 350 cc. If the volume of the head is too small, the moment of inertia of the head is low, and the sweet area is disadvantageously small. In addition, the volume of the head is preferably equal to or less than about 500 cc and more preferably equal to or less than 460 cc. If the volume of the head is too large, the center-of-gravity distance of the head is long, and the club is disadvantageously difficult to swing.

The center-of-gravity distance of the head, or in other words, the distance from the axis of the shaft to the center of gravity of the head is preferably equal to or more than about 25 mm and more preferably equal to or more than about 33 mm. If the center-of-gravity distance is too short, the center of gravity is extremely close to the heel or toe. In the case in which the center of gravity if extremely close to the heel, the initial velocity of the ball in the case of center hitting decreases. In the case in which the center of gravity is extremely close to the toe, the launching angle is disadvantageously low. In addition, the center-of-gravity distance of the head is preferably equal to or less than about 45 mm. In particular, the center-of-gravity distance is preferably equal to or less than about 40 mm, which is the center-of-gravity distance of typical heads, and is more preferably equal to or less than about 38 mm. If the center-of-gravity distance of the head is less than about 40 mm, the solid feeling is improved even in the case of a long golf club. For example, a right-handed golfer can recover the right position of the head face at the time of impact and thus avoid slicing the ball. Thus, the ease of handling of the club is improved.

The golf club having the golf club shaft according to the present invention preferably has a total length of about 46 inches or more. The shaft according to the present invention allows golfers to adjust timing in the same way as in the case of a club with an ordinary length of about 45 inches even when the length of the golf club is equal to or more than about 46 inches. The length of the entire golf club is preferably equal to or less than about 50 inches and more preferably equal to or less than about 48 inches.

EXAMPLES

Figure 2:
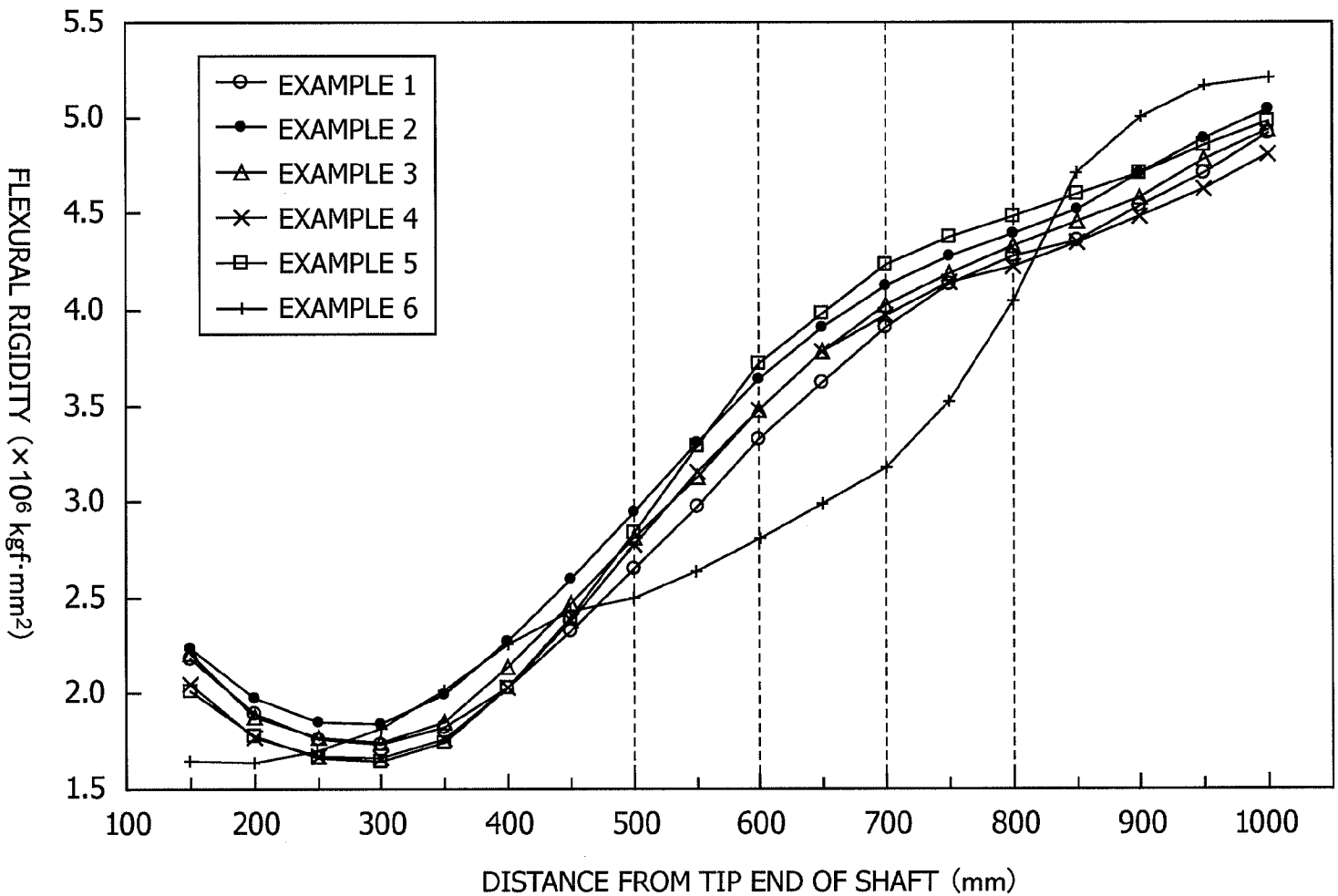
FIG. 2 is a graph showing measurements of the EI value of shafts in Examples 1 to 6.

Five different shafts (Examples 1 to 5) were fabricated, the length, weight and torque of the shafts were measured, and the EI values of the shafts were also measured every 50 mm from the tip end thereof. Table 1 and FIG. 2 show the results. The EI values were measured with Model 4204 and Load Cell 50 kN manufactured by Instron Corporation. The distance between the shaft supports was 300 mm, the load applied to the shafts was 20 kg, and the loading rate was 20 mm/minutes. The indenter was shaped to have 75 R, and the supporting point was shaped to have 5 R. From the EI values measured at the respective points, the rate of EI change Δ1 in the first subsection between a point 500 mm and a point 600 mm from the tip end and the rate of EI change Δ2 in the second subsection between a point 700 mm and a point 800 mm from the tip end were calculated, and the value of Δ1/Δ2 was determined.

TABLE 1

| | Length | Weight | Torque | EI value [$10^6$ kgf · mm$^2$] | | | | Rate of EI change [$10^3$ kgf · mm$^2$/mm] | | Δ1/ |
|---|---|---|---|---|---|---|---|---|---|---|
| | [mm] | [g] | [°] | 150 mm | 750 mm | Min | Max | Δ1 | Δ2 | Δ2 |
| Example 1 | 1170 | 47.7 | 4.7 | 2.18 | 4.14 | 1.73 | 4.91 | 6.8 | 3.7 | 1.83 |
| Example 2 | 1170 | 49.9 | 4.9 | 2.24 | 4.28 | 1.84 | 5.04 | 7.0 | 2.7 | 2.54 |
| Example 3 | 1170 | 43.8 | 5.6 | 2.21 | 4.19 | 1.74 | 4.93 | 6.7 | 3.0 | 2.23 |

TABLE 1-continued

| | Length | Weight | Torque | EI value [$10^6$ kgf · mm$^2$] | | | | Rate of EI change [$10^3$ kgf · mm$^2$/mm] | | Δ1/ |
|---|---|---|---|---|---|---|---|---|---|---|
| | [mm] | [g] | [°] | 150 mm | 750 mm | Min | Max | Δ1 | Δ2 | Δ2 |
| Example 4 | 1170 | 47.6 | 4.4 | 2.05 | 4.14 | 1.66 | 4.81 | 7.0 | 2.5 | 2.80 |
| Example 5 | 1170 | 54.2 | 5.0 | 2.01 | 4.38 | 1.64 | 4.98 | 8.8 | 2.5 | 3.52 |
| Example 6 | 1170 | 49.8 | 4.6 | 1.65 | 3.50 | 1.64 | 5.18 | 3.0 | 8.6 | 0.35 |
| Example 7 | 1171 | 52.2 | 4.4 | 1.96 | 4.26 | 1.75 | 5.41 | 5.9 | 6.1 | 0.96 |
| Example 8 | 1170 | 48.1 | 6.3 | 1.95 | 4.02 | 1.72 | 4.73 | 7.4 | 3.3 | 2.27 |

Figure 3:
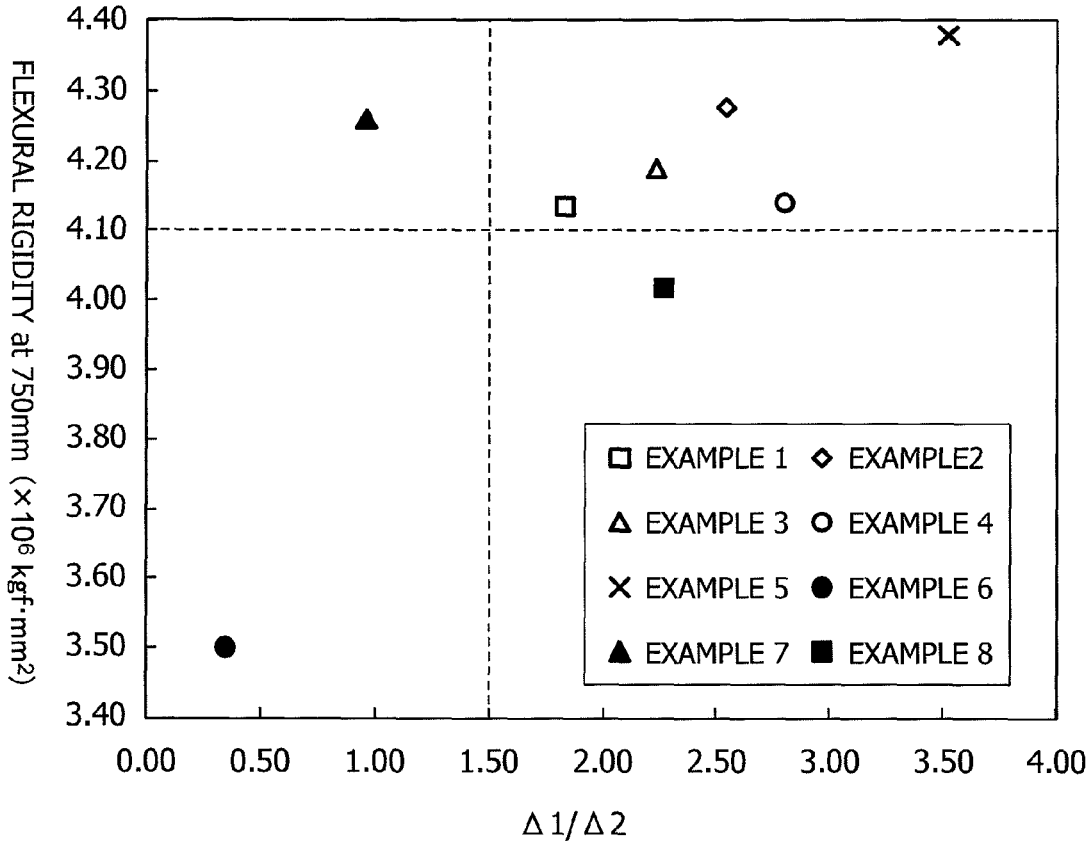
FIG. 3 is a graph showing the EI value against the value of $\Delta1/\Delta2$ in Examples 1 to 8.

As shown in FIG. 2, in Examples 1 to 5, the EI value monotonically increased in a section between a point 500 mm and a point 800 mm from the tip end of the shaft. In addition, in Examples 1 to 5, the EI value was minimized at a point 300 mm from the tip end of the shaft and maximized at a point 1000 mm from the tip end of the shaft. As shown in Table 1, in Examples 1 to 5, the value of Δ1/Δ2 was equal to or higher than 1.8. Furthermore, in Examples 1 to 5, the EI value at a point 750 mm from the tip end of the shaft was equal to or higher than $4.1\times10^6$ kgf*mm$^2$. FIG. 3 shows a graph of the EI value at a point 750 mm against the value of Δ1/Δ2 in Examples 1 to 5.

For comparison, the EI value of a conventional shaft having a typical flexural rigidity distribution (Example 6) was measured in the same way. Table 1 and FIG. 2 show the result. As shown in Table 1 and FIG. 2, the value of Δ1/Δ2 in Example 6 was substantially lower than the values in Examples 1 to 5, and the EI value measured at the point 750 mm from the tip end of the shaft was equal to or lower than $4.0\times10^6$ kgf*mm$^2$. In addition, a shaft having an EI value at the point 750 mm from the tip end of the shaft equal to or higher than $4.1\times10^6$ kgf*mm$^2$ and a value of Δ1/Δ2 ower than 1.0 (Example 7) and a shaft having a value of Δ1/Δ2 equal to or higher than 1.5 and an EI value at the point 750 mm from the tip end of the shaft lower than $4.1\times10^6$ kgf*mm$^2$ (Example 8) were fabricated. Table 1 and FIG. 3 also show the results of measurement of these shafts.

A club head having a volume of 460 cc and a weight of 191 g that has an insertion hole (hosel hole into which the tip end part of the shaft is inserted) having a depth of 32 mm and a 62-diameter grip having a length of 270 mm and a weight of 47 g were attached to the shafts in Examples 1 to 5 and Examples 6 to 8 to assemble golf clubs having a length of 46.5 inches and a club balance of D2. The shaft length of the assembled golf clubs was about 1142 mm. The golf clubs were tested by actually hitting a ball. The tester highly rated the golf clubs using the shafts in Examples 1 to 3 as being easy to adjust timing despite the length of the clubs. The golf clubs using the shafts in Examples 4 and 5 were highly rated as being easy to adjust timing even when the tester swings the clubs slowly.

On the other hand, the golf clubs using the shafts in Examples 6 to 8 were low rated as being difficult to adjust timing. In particular, the shaft in Example 8 was rated as providing a poor impact feeling when the tester missed a shot.

Next, as shown in Table 2, a total of twelve golf clubs were fabricated by attaching four different club heads to each of the shafts in Examples 1, 2, and 8. These golf clubs were also tested by actually hitting a ball. Table 2 shows the results.

TABLE 2

| Golf club | Shaft | Head | | | | Club length [inch] |
|---|---|---|---|---|---|---|
| | | Weight [g] | Volume [cc] | Center-of-gravity distance [mm] | Depth of insertion [mm] | |
| Example 1a | Example 1 | 191 | 360 | 33 | 28 | 46 |
| Example 1b | | 192 | 460 | 36 | 32 | 46.5 |
| Example 1c | | 192 | 460 | 36 | 32 | 48 |
| Example 1d | | 195 | 520 | 42 | 34 | 48 |
| Example 2a | Example 2 | 190 | 360 | 33 | 28 | 46 |
| Example 2b | | 191 | 460 | 36 | 32 | 46.5 |
| Example 2c | | 192 | 460 | 36 | 32 | 48 |
| Example 2d | | 196 | 520 | 42 | 34 | 48 |
| Example 8a | Example 8 | 191 | 360 | 33 | 28 | 46 |
| Example 8b | | 190 | 460 | 36 | 32 | 46.5 |
| Example 8c | | 192 | 460 | 36 | 32 | 48 |
| Example 8d | | 195 | 520 | 42 | 34 | 48 |

The tester rated the golf clubs in Examples 1a and 2a in which club heads have a short center-of-gravity distance as shown in Table 2 as providing a good solid feeling, although slightly excessive. However, since the club heads are small, the golf clubs were rated as being psychologically or physically difficult to handle. On the other hand, the golf clubs in Examples 1d and 2d in which club heads have a long center-of-gravity distance were rated as providing a poor solid feeling and being difficult to handle. In addition, since the heads are heavy, the clubs were rated as being difficult to swing.

The golf clubs in Examples 1b and 2b in which club heads had a moderate center-of-gravity distance and which had a length of 46.5 inches were highly rated as providing an appropriate solid feeling. In addition, the golf club in Example 1b was rated as being highly tolerant of missing a shot. Furthermore, the golf club in Example 2b was rated as providing a good swing feeling and being easier to swing than the club in Example 1b. The golf club in Example 1c that has a club head having the same center-of-gravity distance and has a length of 48 inches was rated as providing a good solid feeling, although slightly excessive compared with the club in Example 1b having a length of 46.5 inches. The golf club in Example 2c that has a club head having the same center-of-gravity distance and has a length of 48 inches was rated as feeling slightly too long but providing a good solid feeling and being easier to adjust timing than the golf club in Example 1c having a length of 46.5 inches.

On the other hand, the golf clubs in Examples 8a to 8d using the shaft in Example 8 were all rated as being difficult to adjust timing. The golf club in Example 8a in which the club head has a short center-of-gravity distance was rated as providing an excessive solid feeling, and the golf club in Example 8d in which the club head has a long center-of-gravity distance was rated as not providing a solid feeling, being difficult to handle, and being heavy and thus difficult to swing. The golf club in Example 8b in which the club head has a moderate center-of-gravity distance and which has a length of 46.5 inches was rated as providing a relatively good solid feeling, but feeling highly twistable and being difficult to adjust timing, and the golf club in Example 8c having a length of 48 inches was rated as being excessively flexible and almost impossible to adjust timing.

What is claimed is:

1. A golf club shaft, comprising a section between a point 500 mm and a point 800 mm from a tip end of the shaft, wherein the flexural rigidity EI of the shaft monotonically increases in the section from the point 500 mm to the point 800 mm, wherein $\Delta 1/\Delta 2$ is at least about 1.8 provided that the rate of change of the flexural rigidity EI of the shaft in a first subsection between a point 500 mm and a point 600 mm from the tip end is denoted by $\Delta 1$, and the rate of change of the flexural rigidity EI of the shaft in a second subsection between a point 700 mm and a point 800 mm from the tip end is denoted by $\Delta 2$, wherein the flexural rigidity EI of the shaft at a point 750 mm from the tip end is at least about $4.1\times10^6$ kgf*mm$^2$, and wherein the flexural rigidity EI of the shaft at a point 155 mm from the tip end is about $2.0\times10^6$ kgf*mm$^2$ to about $2.5\times10^6$ kgf*mm$^2$, and wherein the flexural rigidity EI of the shaft at a point 200 mm to 250 mm from the tip end is lower than a flexural rigidity of any other portion of the shaft along the entire length of the shaft, and wherein the maximum value of the flexural rigidity EI of the shaft along the entire length of the shaft is most about $5.0\times10^6$ kgf*mm$^2$.

2. The golf club shaft according to claim 1, wherein the weight of the shaft is about 35 to about 55 g.

3. The golf club shaft according to claim 1, wherein the minimum value of the flexural rigidity EI of the shaft along the entire length of the shaft is at least about $1.0\times10^6$ kgf*mm$^2$.

4. A golf club, comprising the golf club shaft according to claim 1, wherein the total length of the golf club is about 46 to about 50 inches.

5. The golf club according to claim 4, wherein the golf club has a golf club head having a center-of-gravity distance of about 25 to 45 mm.

6. A golf club, comprising the golf club shaft according to claim 2, wherein the total length of the golf club is about 46 to about 50 inches.

7. A golf club, comprising the golf club shaft according to claim 3, wherein the total length of the golf club is about 46 to about 50 inches.

8. A golf club shaft, comprising a section between a point 500 mm and a point 800 mm from a tip end of the shaft, wherein the flexural rigidity EI of the shaft monotonically increases in the section from the point 500 mm to the point 800 mm, wherein $\Delta 1/\Delta 2$ is at least 1.8 provided that the rate of change of the flexural rigidity EI of the shaft in a first subsection between a point 500 mm and a point 600 mm from the tip end is denoted by $\Delta 1$, and the rate of change of the flexural rigidity EI of the shaft in a second subsection between a point 700 mm and a point 800 mm from the tip end is denoted by $\Delta 2$, wherein the flexural rigidity EI of the shaft at a point 750 mm from the tip end is at least $4.1\times10^6$ kgf*mm$^2$, and wherein the flexural rigidity EI of the shaft at a point 155 mm from the tip end is $2.0\times10^6$ kgf*mm$^2$ to $2.5\times10^6$ kgf*mm$^2$, and wherein the flexural rigidity EI of the shaft at a point 200 mm to 300 mm from the tip end is lowest in any flexural rigidity of the shaft along the entire length of the shaft, the minimum value of the flexural rigidity EI of the shaft being at most $2.0\times10^6$ kg*mm$^2$, and wherein the maximum value of the flexural rigidity EI of the shaft along the entire length of the shaft is at most $5.0\times10^6$ kgf*mm$^2$.

9. The golf club shaft according to claim 8, wherein the minimum value of the flexural rigidity EI of the shaft is at most $1.84\times10^6$ kgf*mm$^2$.

* * * * *